US008753147B2

(12) United States Patent
Montena

(10) Patent No.: US 8,753,147 B2
(45) Date of Patent: Jun. 17, 2014

(54) CONNECTOR HAVING A COUPLING MEMBER FOR LOCKING ONTO A PORT AND MAINTAINING ELECTRICAL CONTINUITY

(71) Applicant: PPC Broadband, Inc., East Syracuse, NY (US)

(72) Inventor: Noah Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 13/947,612

(22) Filed: Jul. 22, 2013

(65) Prior Publication Data

US 2013/0309902 A1 Nov. 21, 2013

Related U.S. Application Data

(62) Division of application No. 13/157,340, filed on Jun. 10, 2011.

(51) Int. Cl.
*H01R 9/05* (2006.01)
*H01R 24/38* (2011.01)
*H01R 25/00* (2006.01)

(52) U.S. Cl.
CPC ..... *H01R 24/38* (2013.01); *H01R 25/003* (2013.01)
USPC ..... 439/578; 439/502

(58) Field of Classification Search
CPC ..... H01R 25/03; H01R 31/02; H01R 24/38; H01R 24/40
USPC ..... 439/253, 357, 502, 578
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. Arris Group Inc. [online]. 3 pages [retrieved on Apr. 22, 2010]. Retrieved from the Internet<URL: http://www.arrisi.com/special/digiconAVL.asp>.

*Primary Examiner* — Khiem Nguyen
(74) *Attorney, Agent, or Firm* — Hiscock & Barclay, LLP

(57) ABSTRACT

A jumper comprising a first connector, wherein the first connector includes a post configured to receive a center conductor surrounded by a dielectric of a coaxial cable, a connector body attached to the post, and a coupling member attached to the post, the coupling member having one or more resilient contacts, wherein the resilient contacts are configured to pass over the external threads in a first axial direction, and physically engage the external threads in a second axial direction, and a second connector, wherein the first connector is operably affixed to a first end of the coaxial cable, and the second connector is operably affixed to a second end of the coaxial cable is provided.

19 Claims, 13 Drawing Sheets

(56) References Cited

U.S. PATENT DOCUMENTS 2,102,495 A 12/1937 England
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,754,487 A 7/1956 Carr et al.
2,755,331 A 7/1956 Melcher
2,757,351 A 7/1956 Klostermann
2,762,025 A 9/1956 Melcher
2,805,399 A 9/1957 Leeper
2,870,420 A 1/1959 Malek
3,001,169 A 9/1961 Blonder
3,015,794 A 1/1962 Kishbaugh
3,091,748 A 5/1963 Takes et al.
3,094,364 A 6/1963 Lingg
3,184,706 A 5/1965 Atkins
3,194,292 A 7/1965 Borowsky
3,196,382 A 7/1965 Morello, Jr.
3,245,027 A 4/1966 Ziegler, Jr.
3,275,913 A 9/1966 Blanchard et al.
3,278,890 A 10/1966 Cooney
3,281,757 A 10/1966 Bonhomme
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,677 A 10/1967 Daum
3,355,698 A 11/1967 Keller
3,373,243 A 3/1968 Janowiak et al.
3,390,374 A 6/1968 Forney, Jr.
3,406,373 A 10/1968 Forney, Jr.
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,601,776 A 8/1971 Curl
3,629,792 A 12/1971 Dorrell
3,633,150 A 1/1972 Swartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,706,958 A 12/1972 Blanchenot
3,710,005 A 1/1973 French
3,739,076 A 6/1973 Schwartz
3,744,007 A 7/1973 Horak
3,744,011 A 7/1973 Blanchenot
3,778,535 A 12/1973 Forney, Jr.
3,781,762 A 12/1973 Quackenbush
3,781,898 A 12/1973 Holloway
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,858,156 A 12/1974 Zarro
3,879,102 A 4/1975 Horak
3,886,301 A 5/1975 Cronin et al.
3,907,399 A 9/1975 Spinner
3,910,673 A 10/1975 Stokes
3,915,539 A 10/1975 Collins
3,936,132 A 2/1976 Hutter
3,953,097 A 4/1976 Graham
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
4,017,139 A 4/1977 Nelson
4,022,966 A 5/1977 Gajajiva
4,030,798 A 6/1977 Paoli
4,046,451 A 9/1977 Juds et al.
4,053,200 A 10/1977 Pugner
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,106,839 A 8/1978 Cooper
4,125,308 A 11/1978 Schilling
4,126,372 A 11/1978 Hashimoto et al.
4,131,332 A 12/1978 Hogendobler et al.
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Boutros
4,225,162 A 9/1980 Dola
4,227,765 A 10/1980 Neumann et al.
4,229,714 A 10/1980 Yu
4,250,348 A 2/1981 Kitagawa
4,280,749 A 7/1981 Hemmer
4,285,564 A 8/1981 Spinner
4,290,663 A 9/1981 Fowler et al.
4,296,986 A 10/1981 Herrmann et al.
4,307,926 A 12/1981 Smith
4,322,121 A 3/1982 Riches et al.
4,326,769 A 4/1982 Dorsey et al.
4,339,166 A 7/1982 Dayton
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,470,657 A 9/1984 Deacon
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit

(56) References Cited

U.S. PATENT DOCUMENTS

| | | | |
|---|---|---|---|
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A | 1/1988 | Schildkraut et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,813,886 | A | 3/1989 | Roos et al. |
| 4,820,185 | A | 4/1989 | Moulin |
| 4,834,675 | A | 5/1989 | Samchisen |
| 4,835,342 | A | 5/1989 | Guginsky |
| 4,836,801 | A | 6/1989 | Ramirez |
| 4,838,813 | A | 6/1989 | Pauza et al. |
| 4,854,893 | A | 8/1989 | Morris |
| 4,857,014 | A | 8/1989 | Alf et al. |
| 4,867,706 | A | 9/1989 | Tang |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,073,129 | A | 12/1991 | Szegda |
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,494 | A | 5/1994 | Flanagan et al. |
| 5,318,459 | A | 6/1994 | Shields |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawaguchi et al. |
| 5,389,005 | A | 2/1995 | Kodama |
| 5,393,244 | A | 2/1995 | Szegda |

(56) References Cited

U.S. PATENT DOCUMENTS 5,397,252 A 3/1995 Wang
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 * 7/2001 Arcykiewicz et al. ..... 439/253
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,085 B1 * 3/2003 Perlman ..... 725/82
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,094,971 B2 * 8/2006 Johnsen ..... 174/84 R
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 5/2008 Gale

(56) References Cited

U.S. PATENT DOCUMENTS

| | | | | |
|---|---|---|---|---|
| 7,393,245 | B2 | 7/2008 | Palinkas et al. | |
| 7,452,239 | B2 | 11/2008 | Montena | |
| 7,455,550 | B1 | 11/2008 | Sykes | |
| 7,462,068 | B2 | 12/2008 | Amidon | |
| 7,476,127 | B1 | 1/2009 | Wei | |
| 7,479,035 | B2 | 1/2009 | Bence et al. | |
| 7,488,210 | B1 | 2/2009 | Burris et al. | |
| 7,494,355 | B2 | 2/2009 | Hughes et al. | |
| 7,497,729 | B1 | 3/2009 | Wei | |
| 7,507,117 | B2 | 3/2009 | Amidon | |
| 7,544,094 | B1 | 6/2009 | Paglia et al. | |
| 7,566,236 | B2 | 7/2009 | Malloy et al. | |
| 7,607,942 | B1 | 10/2009 | Van Swearingen | |
| 7,674,132 | B1 | 3/2010 | Chen | |
| 7,682,177 | B2 | 3/2010 | Berthet | |
| 7,727,011 | B2 | 6/2010 | Montena et al. | |
| 7,753,705 | B2 | 7/2010 | Montena | |
| 7,794,275 | B2 | 9/2010 | Rodrigues | |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,874,870 | B1 | 1/2011 | Chen | |
| 7,887,354 | B2 | 2/2011 | Holliday | |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 7,955,126 | B2 | 6/2011 | Bence et al. | |
| 8,029,315 | B2 | 10/2011 | Purdy et al. | |
| 8,062,044 | B2 | 11/2011 | Montena et al. | |
| 8,075,338 | B1 | 12/2011 | Montena | |
| 8,079,860 | B1 | 12/2011 | Zraik | |
| 8,152,551 | B2 | 4/2012 | Zraik | |
| 8,157,589 | B2 | 4/2012 | Krenceski et al. | |
| 8,167,635 | B1 | 5/2012 | Mathews | |
| 8,167,636 | B1 | 5/2012 | Montena | |
| 8,167,646 | B1 | 5/2012 | Mathews | |
| 8,172,612 | B2 | 5/2012 | Bence et al. | |
| 8,192,237 | B2 | 6/2012 | Purdy et al. | |
| 8,221,161 | B2 * | 7/2012 | Leibfried, Jr. | 439/578 |
| 8,414,322 | B2 | 4/2013 | Montena | |
| 8,454,395 | B2 * | 6/2013 | Xu et al. | 439/852 |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2003/0224657 | A1 | 12/2003 | Malloy | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2007/0026734 | A1 | 2/2007 | Bence et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2008/0102696 | A1 | 5/2008 | Montena | |
| 2008/0289470 | A1 | 11/2008 | Aston | |
| 2009/0029590 | A1 | 1/2009 | Sykes et al. | |
| 2009/0098770 | A1 | 4/2009 | Bence et al. | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 | 9/2010 | Youtsey | |
| 2010/0255720 | A1 | 10/2010 | Radzik et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1 | 1/2012 | Zraik | |
| 2012/0094532 | A1 | 4/2012 | Montena | |
| 2012/0122329 | A1 | 5/2012 | Montena | |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 4503793 | B2 | 1/2002 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |
| WO | 2012061379 | A2 | 5/2012 |

* cited by examiner

CONNECTOR HAVING A COUPLING MEMBER FOR LOCKING ONTO A PORT AND MAINTAINING ELECTRICAL CONTINUITY

PRIORITY CLAIM

This application is a divisional application of U.S. patent application Ser. No. 13/157,340, filed on Jun. 10, 2011, and entitled "Connector Having a Coupling Member for Locking Onto a Port and Maintaining Electrical Continuity."

CROSS-REFERENCE TO RELATED APPLICATION

This application is a related to the following commonly-owned, co-pending application: U.S. patent application Ser. No. 13/157,340, filed on Jun. 10, 2011.

FIELD OF TECHNOLOGY

The following relates to connectors used in coaxial cable communication applications, and more specifically to embodiments of a push-on connector having a coupling member for maintaining continuity through a connector and retaining the connector onto a corresponding port.

BACKGROUND

Connectors for coaxial cables are typically connected onto complementary interface ports to electrically integrate coaxial cables to various electronic devices. Push-on connectors are widely used by consumers for their ease of use, and apparent adequacy, but they rarely stay properly secured onto the port over time. Even push-on connectors designed to lock the connector onto a port can slip off the port if the cable is tugged, and the range of allowable port diameters makes it extremely difficult to create sufficient friction between the push-on connector and the tops of the external threads of both small and large ports. By contrast, connectors involving a threaded coupling member can provide enough retention force up to the breaking strength of a coaxial cable; however, threaded coupling members must also be rotated onto the port during installation. Furthermore, it is desirable to maintain continuity through a coaxial cable connector, which typically involves the continuous contact of conductive connector components which can prevent radio frequency (RF) leakage and ensure a stable ground connection.

Thus, a need exists for an apparatus and method for preventing disengagement of a push-on connector from a port. A need also exists for a push-on connector that can lock onto a port while also ensuring continuous contact between conductive components of a connector.

SUMMARY

A first general aspect relates to a coupling member comprising a body defined by an inner surface and an outer surface between a first end a second end, at least one resilient contact extending a distance from the inner surface of the body, the at least one resilient contact configured to provide a retention force, and at least one resilient protrusion extending a distance from the inner surface of the body, the at least one resilient positioned proximate the second end of the body and configured to contact a conductive surface.

A second general aspect relates to a coaxial cable connector for mating with an interface port having external threads, comprising a post configured to receive a center conductor surrounded by a dielectric of a coaxial cable, a connector body attached to the post, a coupling member attached to the post, the coupling member having one or more resilient contacts, wherein the resilient contacts are configured to pass over the external threads in a first axial direction, and physically engage the external threads in a second axial direction.

A third general aspect relates to a coaxial cable connector for connecting to an interface port comprising a post having configured to receive a prepared end of a coaxial cable having a center conductor surrounded by a dielectric, a connector body attached to the post, a coupling member attached to the post, the coupling member having a first end and a second end, wherein the coupling member includes a first set of contacts proximate the second end configured to maintain electrical continuity between the coupling member and the post, and a second set of contacts configured to provide a retention force in an axial direction between the coupling member and the port.

A fourth general aspect relates to a coaxial cable connector adapted to mate with a port, comprising a post configured to receive a center conductor surrounded by a dielectric of a coaxial cable, a connector body attached to the post, a coupling member operably attached to the post, the coupling member having a first end and a second end, and a means for providing a retention force in an axial direction between the coupling member and the port, wherein the means for providing the retention force is integral with the coupling member.

A fifth general aspect relates to a connector for connecting to an interface port comprising a post having configured to receive a prepared end of a coaxial cable having a center conductor surrounded by a dielectric, a connector body attached to the post, a coupling member, the coupling member having a first end and a second end, wherein the coupling member includes a first set of contacts proximate the second end configured to maintain electrical continuity through the connector, and a second set of contacts configured to provide a retention force in an axial direction between the coupling member and the port.

A sixth general aspect relates to a method of retaining a connector onto a port in an axial direction, comprising providing a post configured to receive a center conductor surrounded by a dielectric of a coaxial cable, a connector body attached to the post, a coupling member attached to the post, wherein the coupling member has a first and second end, and forming one or more resilient contacts on the coupling member, wherein the resilient contacts are configured to pass over the external threads in a first axial direction, and physically engage the external threads in a second axial direction.

A seventh general aspect relates to a jumper comprising a first connector, wherein the first connector includes a post configured to receive a center conductor surrounded by a dielectric of a coaxial cable, a connector body attached to the post, and a coupling member attached to the post, the coupling member having one or more resilient contacts, wherein the resilient contacts are configured to pass over the external threads in a first axial direction, and physically engage the external threads in a second axial direction, and a second connector, wherein the first connector is operably affixed to a first end of a coaxial cable, and the second connector is operably affixed to a second end of the coaxial cable.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
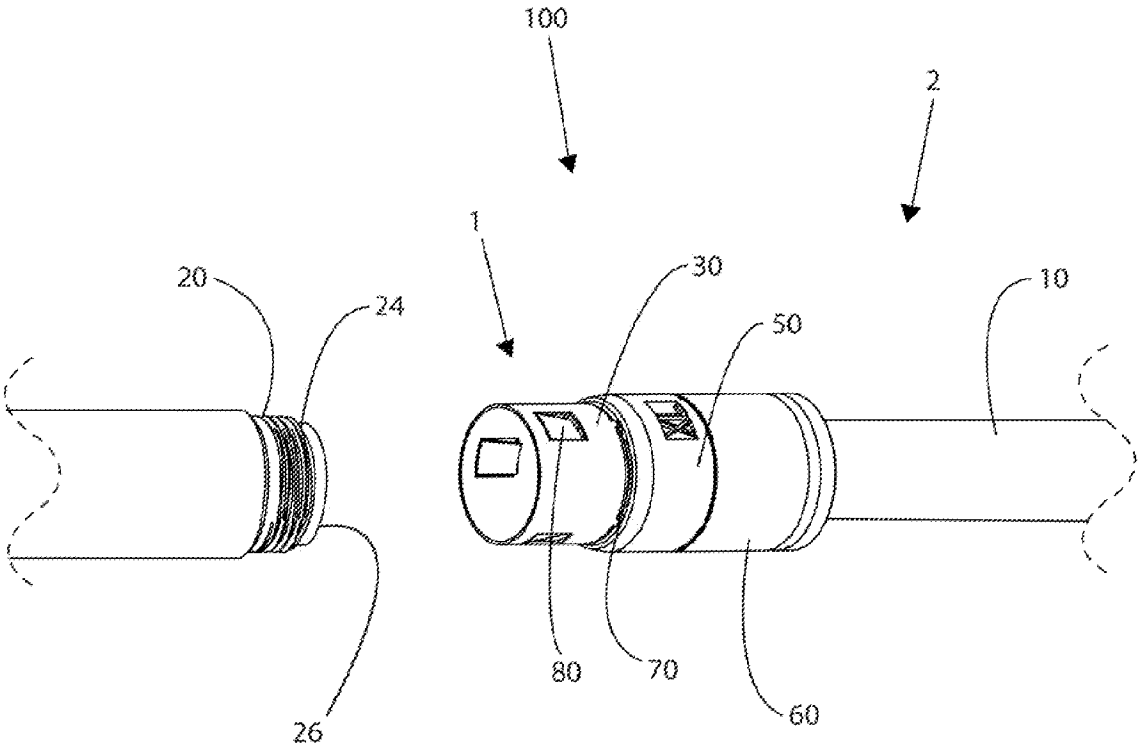
FIG. 1 depicts a perspective view of a first embodiment of a coaxial cable connector.
Figure 12:
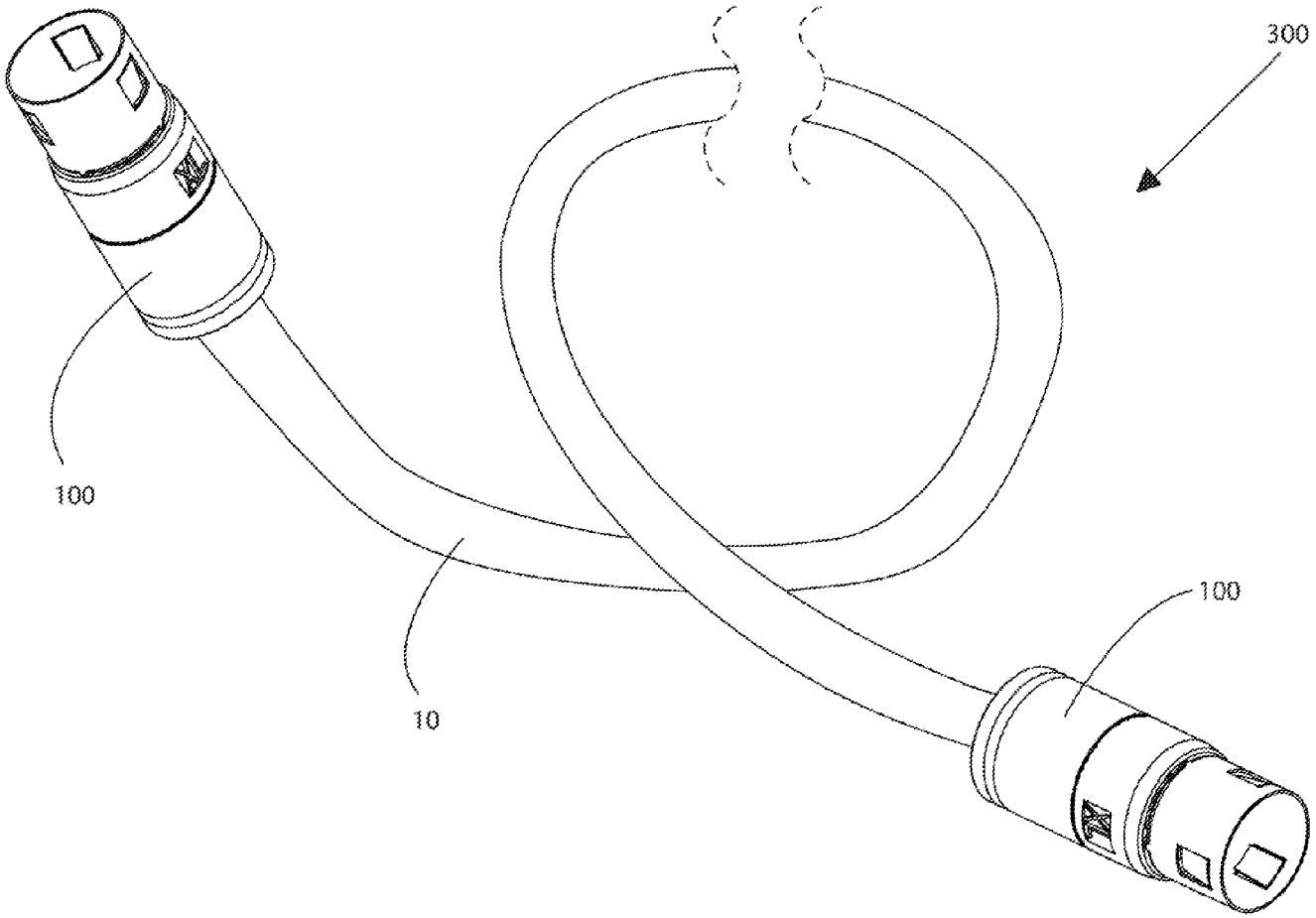
FIG. 12 depicts a perspective view of an embodiment of a jumper.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be a push-on connector, push-on F connector, or similar coaxial cable connector that requires only an axial force to mate with a corresponding port 20 (e.g. does not require lining up threads and rotating a coupling member). Two connectors, such as connector 100 may be utilized to create a jumper 300 that may be packaged and sold to a consumer, as shown in FIG. 12. Jumper 300 may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper 300 includes both an uncompressed/open position and a compressed/closed position of the connector while affixed to the cable. For example, embodiments of jumper 300 may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10.

Figure 2:
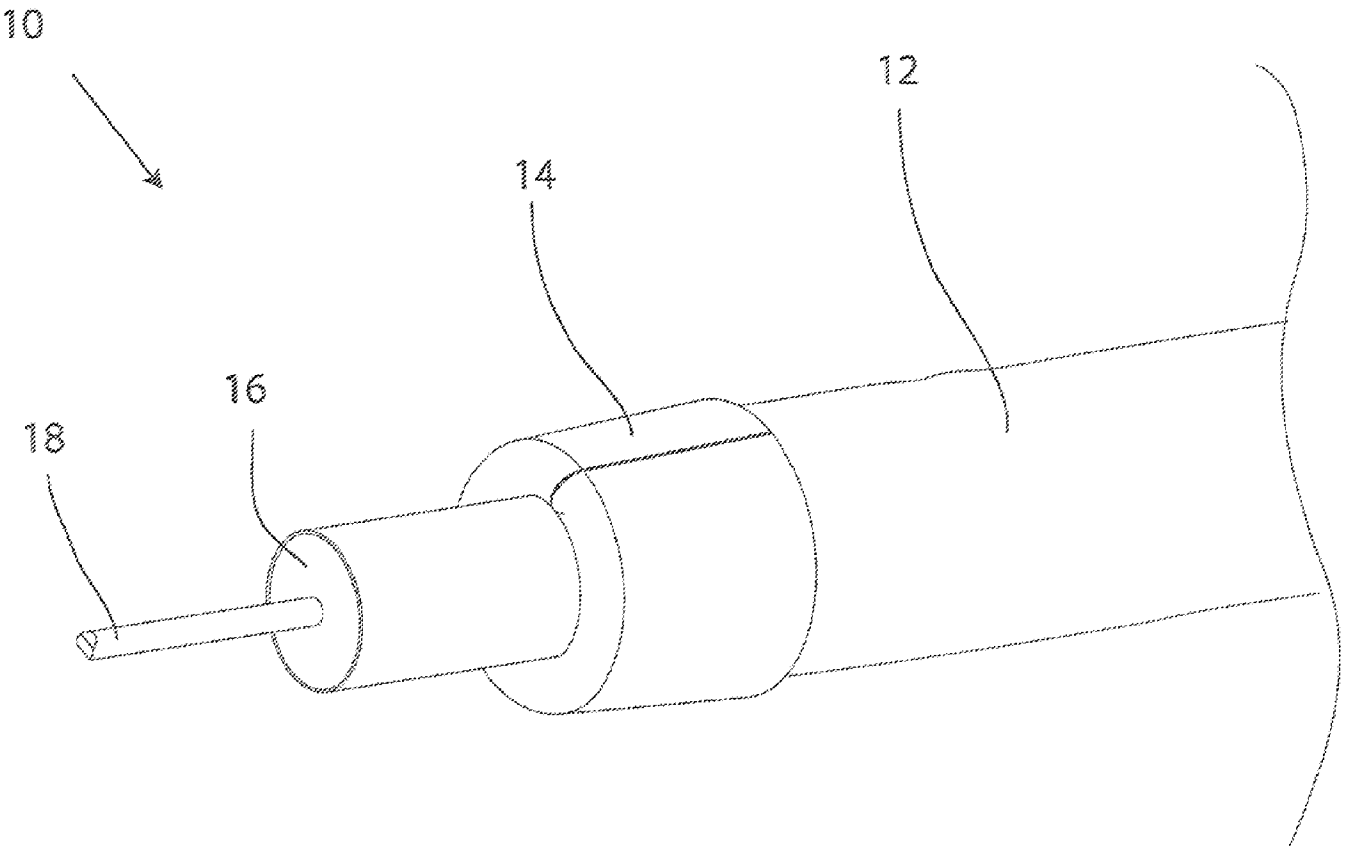
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12*a*, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to prevent ingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Referring back to FIG. 1, the connector 100 may mate with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 24. However, various embodiments may employ a smooth surface, or partially smooth surface, as opposed to a completely threaded exterior surface. In addition, the coaxial cable interface port 20 may comprise a mating edge 26. It should be recognized that the radial thickness and/or the length of the coaxial cable interface port 20 and/or the conductive receptacle may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. The threads 24 may also include a working surface 27, which may be defined by the pitch and depth requirements of the port 20. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Figure 3:
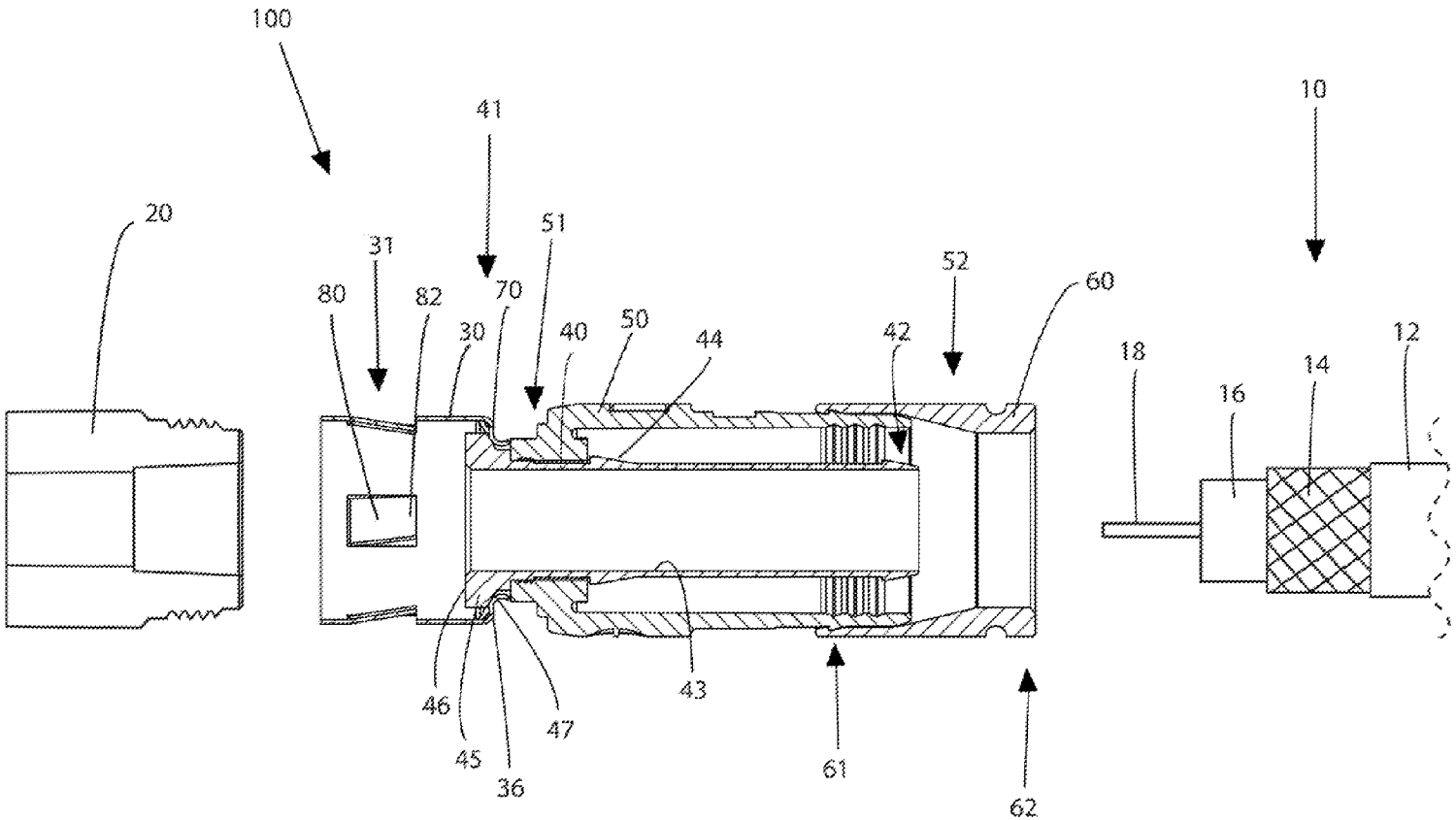
FIG. 3 depicts a cross-sectional view of the embodiment of the connector.

Referring further to FIGS. 1 and 3, embodiments of a connector 100 may include a post 40, a coupling member 30, a connector body 50, a fastener member 60, and a biasing member 70. Embodiments of connector 100 may also include a post 40 configured to receive a center conductor 18 surrounded by a dielectric 16 of a coaxial cable 10, a connector body 50 attached to the post 40, a coupling member 30 attached to the post 40, the coupling member 30 having one or more resilient contacts 80, wherein the resilient contacts 80 are configured to pass over the external threads 24 in a first axial direction, and physically engage the external threads 24 in a second axial direction. Further embodiments of connector 100 may include a post 40 having configured to receive a prepared end of a coaxial cable 10 having a center conductor 18 surrounded by a dielectric 16, a connector body 50 attached to the post 40, a coupling member 30 attached to the post 40, the coupling member 30 having a first end 31 and a second end 32, wherein the coupling member 30 includes a first set of contacts 70 proximate the second end 32 configured to maintain electrical continuity between the coupling member 30 and the post 40, and a second set of contacts 80 configured to provide a retention force in an axial direction between the coupling member 30 and the port 20.

Embodiments of connector 100 may include a post 40. The post 40 comprises a first end 41, a second end 42, an inner surface 43, and an outer surface 44. Furthermore, the post 40 may include a flange 45, such as an externally extending annular protrusion, located proximate or otherwise near the first end 41 of the post 40. The flange 45 may include an outer tapered surface 47 facing the second end 42 of the post 40 (i.e. tapers inward toward the second end 42 from a larger outer diameter proximate or otherwise near the first end 41 to a smaller outer diameter. The outer tapered surface 47 of the flange 45 may correspond to a tapered surface of a lip 36 of the coupling member 30. Further still, an embodiment of the post 40 may include a surface feature such as a lip or protrusion that may engage a portion of a connector body 50 to secure axial movement of the post 40 relative to the connector body 50. However, the post may not include such a surface feature, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 4:
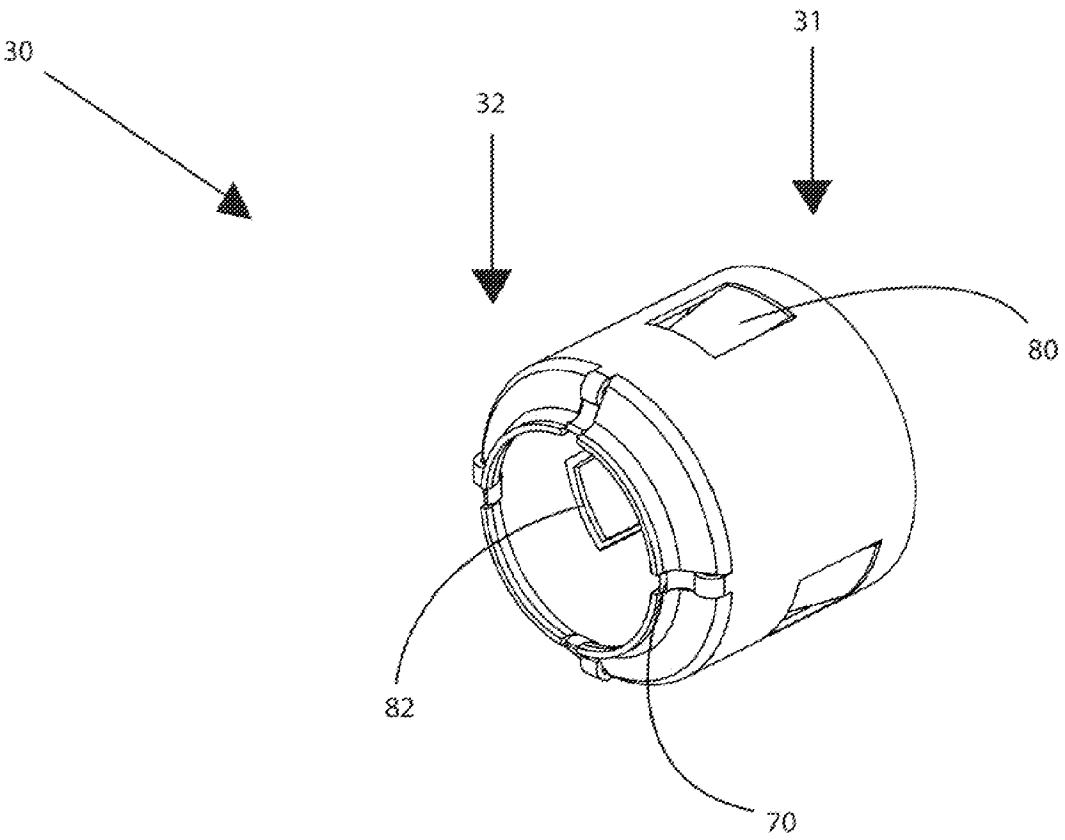
FIG. 4 depicts a perspective view of an embodiment of a coupling member.
Figure 5:
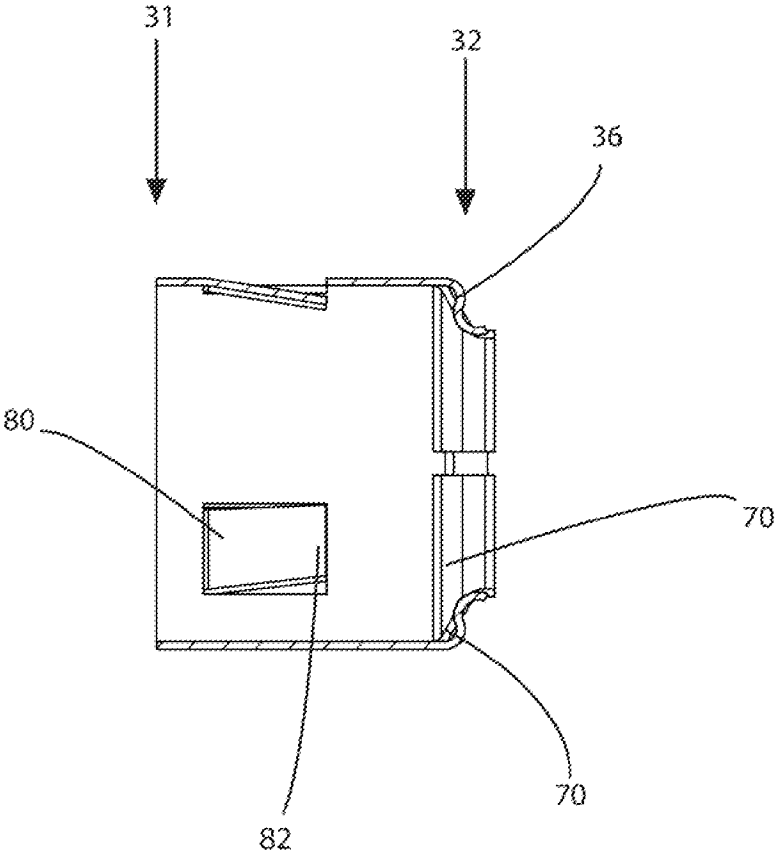
FIG. 5 depicts a first cross-sectional view of an embodiment of the coupling member.
Figure 6:
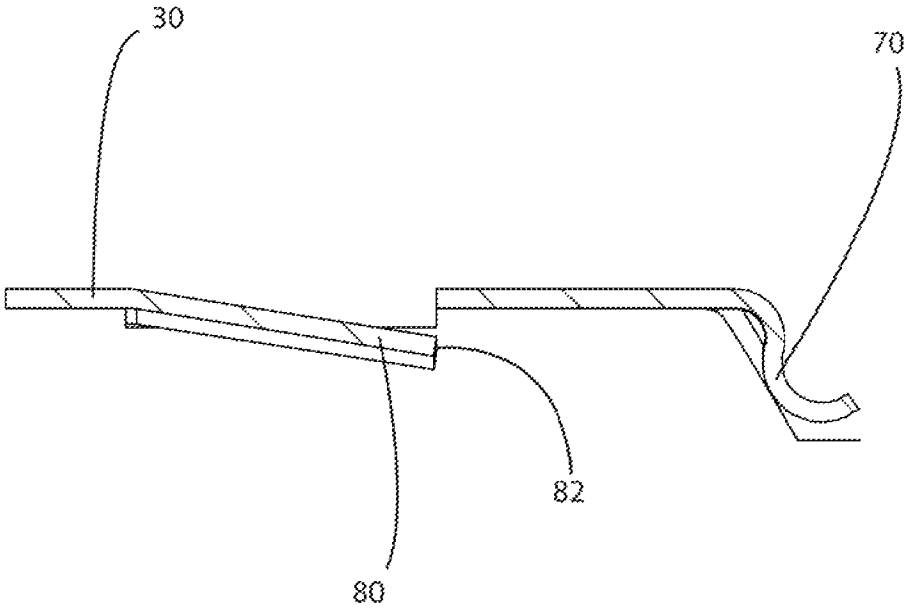
FIG. 6 depicts a second cross-sectional view of an embodiment of the coupling member.

With continued reference to FIGS. 1 and 3, and further reference to FIGS. 4-6, embodiments of connector 100 may include a coupling member 30. The coupling member 30 may be a nut, a port coupling member, rotatable port coupling member, and the like, for various embodiments of a push-on connector, F-connector, cable connector (including triaxial and coaxial), and may be a coupling member for a device/connector that does not include a coaxial or triaxial cable. The coupling member 30 may include a first end 31, second end 32, an inner surface 33, and an outer surface 34. The inner surface 33 of the coupling member 30 may be a smooth, non-threaded surface to allow the coupling member 30 to be axially inserted over an interface port, such as port 20. However, the coupling member 30 may be rotatably secured to the post 40 to allow for rotational movement about the post 40. Embodiments of coupling member 30 may include a body 38 defined by an inner surface 33 and an outer surface 34 between a first end 31 and a second end 32, at least one resilient contact 80 extending a distance from the inner surface 33 of the body 38, the at least one resilient contact 80 configured to provide a retention force, and at least one resilient protrusion 70 extending a distance from the inner surface 33 of the body 38, the at least one resilient protrusion 70 positioned proximate the second end 32 of the body 38 and configured to contact a conductive surface.

Furthermore, embodiments of coupling member 30 may include a first set of contacts 70 for maintaining physical and electrical contact between the post 40 and the coupling member 30 to extend a RF shield and grounding through the connector 100. Embodiments of the first set of contacts 70 may be structurally integral with the coupling member 30. Alternatively, the first set of contacts 70 may be integrally connected to a second set of contacts 80 through a conductive (e.g. metal) strip that can be embedded into the body 38 of the coupling member 30. The first set of contacts 70 may be located on/along an annular internal lip 36 proximate the second end 32 of the coupling member 30; the lip 36 may also be configured to hinder axial movement of the post 40. The first set of contacts 70 may be one or more resilient projections, bumps, and the like, that project and/or extend radially inward towards the outer surface 44 of the post 40 proximate or otherwise near the flange 45 of the post 40. For example, the first set of contacts 70 may physically and electrically contact the tapered surface 47 of the post 40 to maintain electrical continuity with the post 40 regardless of the screw-advance of the coupling member 30 onto a port 20. Embodiments of coupling member 30 may include a single contact 70 proximate the second end 32 of the coupling member 30, or may include a plurality of contacts 70 spaced apart from each other extending around or partially around the coupling member 30 proximate the second end 32. Thus, the locations, configurations, orientations, and the number of contacts 70 may vary, so long as at least one contact 70 physically engages (e.g. biases against) the post 40 to extend electrical continuity therebetween. The resilient nature of the contacts 70 (e.g. resilient protrusions, bumps, etc.) can provide a biasing force against the rigid post 40 to establish constant contact between the post 40 and the contacts 70. For example, while operably configured (e.g. when the connector is fully advanced onto the port 20 and/or connector 100 is in a compressed position), the resilient contacts 70 may come into contact with the post 40, and deflect slightly radially outward (back towards the coupling member 30), and due to the resiliency of the contacts 70, the contacts 70 can exert a constant biasing force in a radially inward direction against the post 40 to establish and maintain electrical continuity between the coupling member 30 and the post 40.

Figure 7:
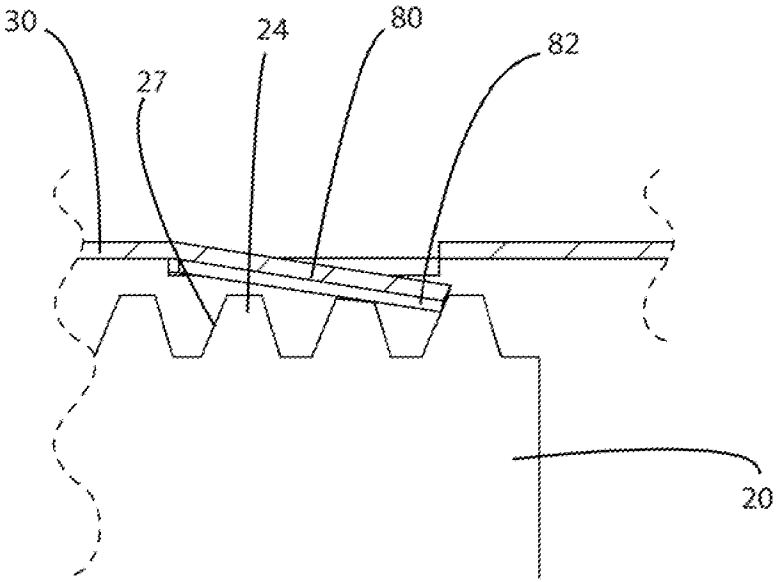
FIG. 7 depicts a cross-sectional view of an embodiment of a resilient contact having a tip engaged with a thread of a port.

Furthermore, the coupling member 30 may include a second set of contacts 80 to provide a retention force between the coupling member 30 and the corresponding mating port 20. Embodiments of the second set of contacts 80 may be structurally integral with the coupling member 30. Alternatively, the second set of contacts 80 may be integrally connected to the first set of contacts 70 through a conductive (e.g. metal) strip embedded into the body 38 of the coupling member 30. The second set of contacts 80 may be located on/along/around the body 38 of the coupling member 30 at any point between the first end 31 and the lip 36 of the coupling member 30. The second set of contacts 80 may be resilient projections, prongs, fingers, or one-way latch fingers that project and/or extend radially inwards from an otherwise smooth inner surface 33 into the generally axial opening of the coupling member 30 and partially axially towards at least one of the first end 31 and the second end 32. Embodiments of the contacts 80 may be designed to pass over the threads 34 of the port 20 in a first axial direction (e.g. axially advancing the coupling member 30 onto the port 20), but may mechanically interfere with one or more threads 24 in a second axial direction (e.g. axially removing the coupling member 30 from the port 20). For instance, the second set of contacts 80 may be biased in a direction to allow the crests of the threads 24 of the port 20 to push the contacts 80 outward during forward axial movement of the coupling member 30 as the coupling member 30 is advanced onto the port 20, but which come to rest with the tips 82 of the contacts 80 lodged securely against the working surface of the port threads 24, preventing the release of the connector 100 if pulled in an opposite axial direction, as shown in FIG. 7. The contact 80 and/or the tip 82 of the contact 80 may include a tapered or ramped surface design that may act as a ratcheting surface which allows the contacts 80 (or just the tips 82 to pass over the threads 24 in a first axial direction, but mechanically prevent motion in the second, opposite axial direction). Other embodiments of tip 82 may include a curved or rounded configuration to maximize or increase a retention force with a surface, such as working surface 27 of port 20. The engagement between the second set of contacts 80 and the threads 24 of the port 20 can provide a retention force between the connector 100 and the port 20 in an axial direction. To disengage the connector 100 from the port 20, a user may simply rotate/turn the coupling member 30 in a direction which loosens the coupling member 30 from the port 20. For example, rotating the coupling member 30 in a counter-clockwise direction may unthread the contacts 80 from the threads 24 of the port 20. Embodiments of coupling member 30 may include a single contact 80, or may include a plurality of contacts 80 spaced apart from each other extending around or partially around the coupling member 30 at various axial positions on the coupling member 30. Thus, the locations, configurations, orientations, and the number of contacts 80 may vary, so long as at least one contact 80 physically engages the port 20 when the coupling member 30 is advanced onto the port 20.

The coupling member 30, including the first and second set of contacts 70, 80, may be formed of conductive materials facilitating shielding/grounding through the coupling member 30. Accordingly the coupling member 30 may be configured to extend an electromagnetic buffer by electrically contacting conductive surfaces of an interface port 20 when a coaxial cable connector, such as connector 100, is advanced onto the port 20. In addition, the coupling member 30 may be formed of non-conductive material and function only to physically secure and advance a connector 100 onto an interface port 20. Moreover, the coupling member 30 may be formed of both conductive and non-conductive materials. In addition, the coupling member 30 may be formed of metals or polymers or other materials that would facilitate a rigidly formed body. Manufacture of the coupling member 30 may include casting, extruding, cutting, turning, tapping, drilling, injection molding, blow molding, or other fabrication methods that may provide efficient production of the component. Further embodiments of the coupling member 30 may be formed of plastic, or other non-conductive, non-metal material having a single (or more than one) conductive strip embedded into the body 38 of the coupling member 30. Thus, conductive materials need not completely surround the port 20; a conductive strip integrally connecting at least one resilient contact 80 and at least one resilient protrusion 70 may contact the surface of a port or a conductive surface (e.g. a post or other conductive surface of a cable connector). In other words, a strip of metal having at least one resilient contact 80 at one end and at least one resilient protrusion 70 at the other end may be embedded into an embodiment of a non-conductive, non-metal coupling member 30, wherein the conductive strip, particularly, the resilient contact(s) 80 and the resilient protrusion(s) 70, contact matably corresponding conductive surfaces to extend electrical continuity.

Referring still to FIGS. 1 and 3, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the first end 51 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the first end 51 of the connector body 50. Furthermore, the connector body 50 may include a semi-rigid, yet compliant outer surface 54, wherein the outer surface 54 may be configured to form an annular seal when the second end 52 is deformably compressed against a received coaxial cable 10 by operation of a fastener member 60. The connector body 50 may include an external annular detent 58 located along the outer surface 54 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIGS. 1 and 3, embodiments of a coaxial cable connector 100 may include a fastener member 60. The fastener member 60 may have a first end 61, second end 62, inner surface 63, and outer surface 64. In addition, the fastener member 60 may include an internal annular protrusion located proximate the first end 61 of the fastener member 60 and configured to mate and achieve purchase with the annular detent 58 on the outer surface 54 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the second end 62 of the fastener member 60 and a second opening or inner bore having a larger, second inner diameter positioned proximate or otherwise near the first end 61 of the fastener member 60. The ramped surface 66 may act to deformably compress the outer surface 54 of the connector body 50 when the fastener member 60 is operated to secure a coaxial cable 10. For example, the narrowing geometry will compress squeeze against the cable, when the fastener member 60 is compressed into a tight and secured position on the connector body 50. Additionally, the fastener member 60 may comprise an exterior surface feature positioned proximate with or close to the second end 62 of the fastener member 60. The surface feature may facilitate gripping of the fastener member 60 during operation of the connector 100. Although the surface feature is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the coupling member 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Figure 8:
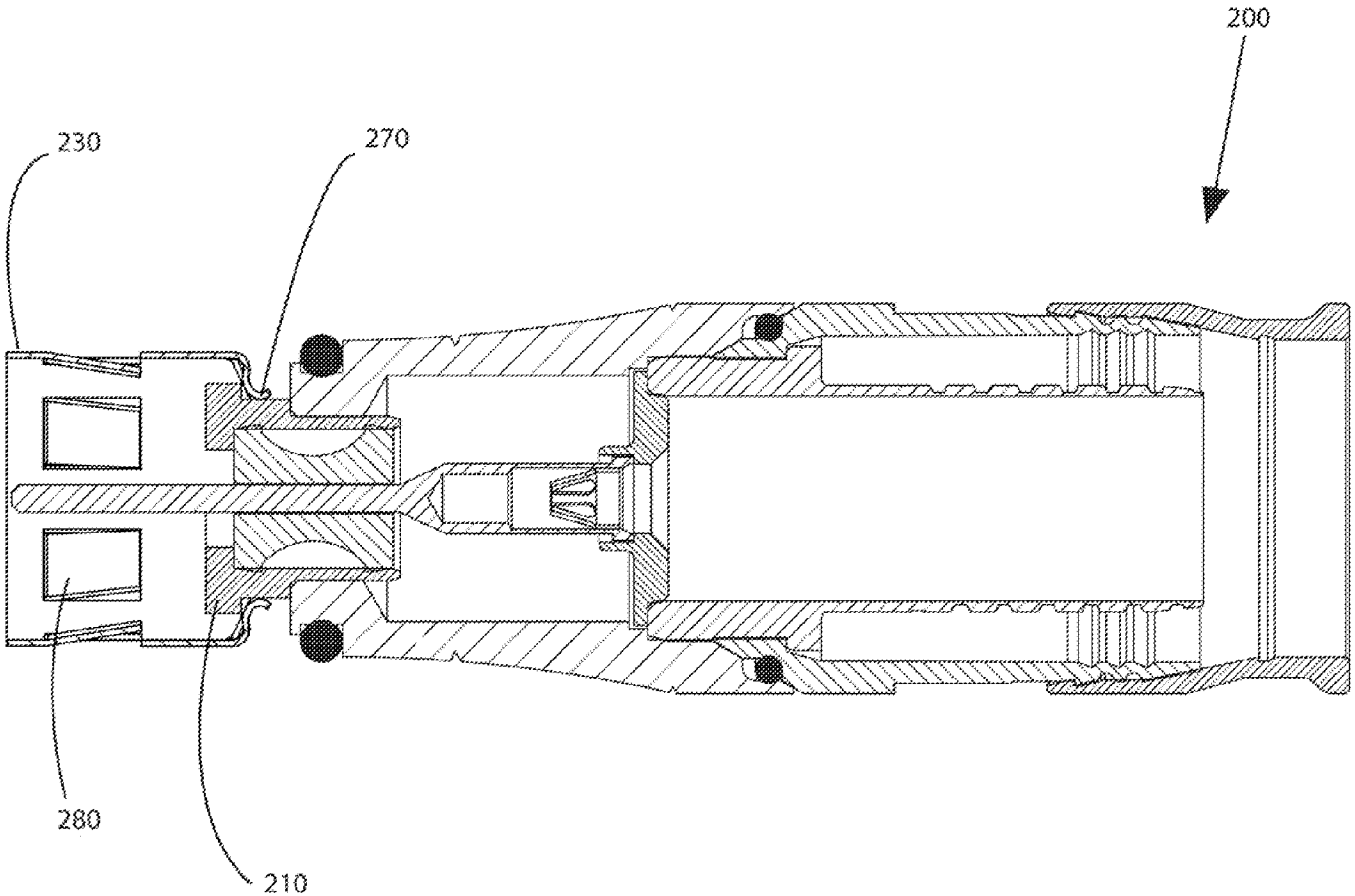
FIG. 8 depicts a cross-sectional view of a second embodiment of a coaxial cable connector.
Figure 9:
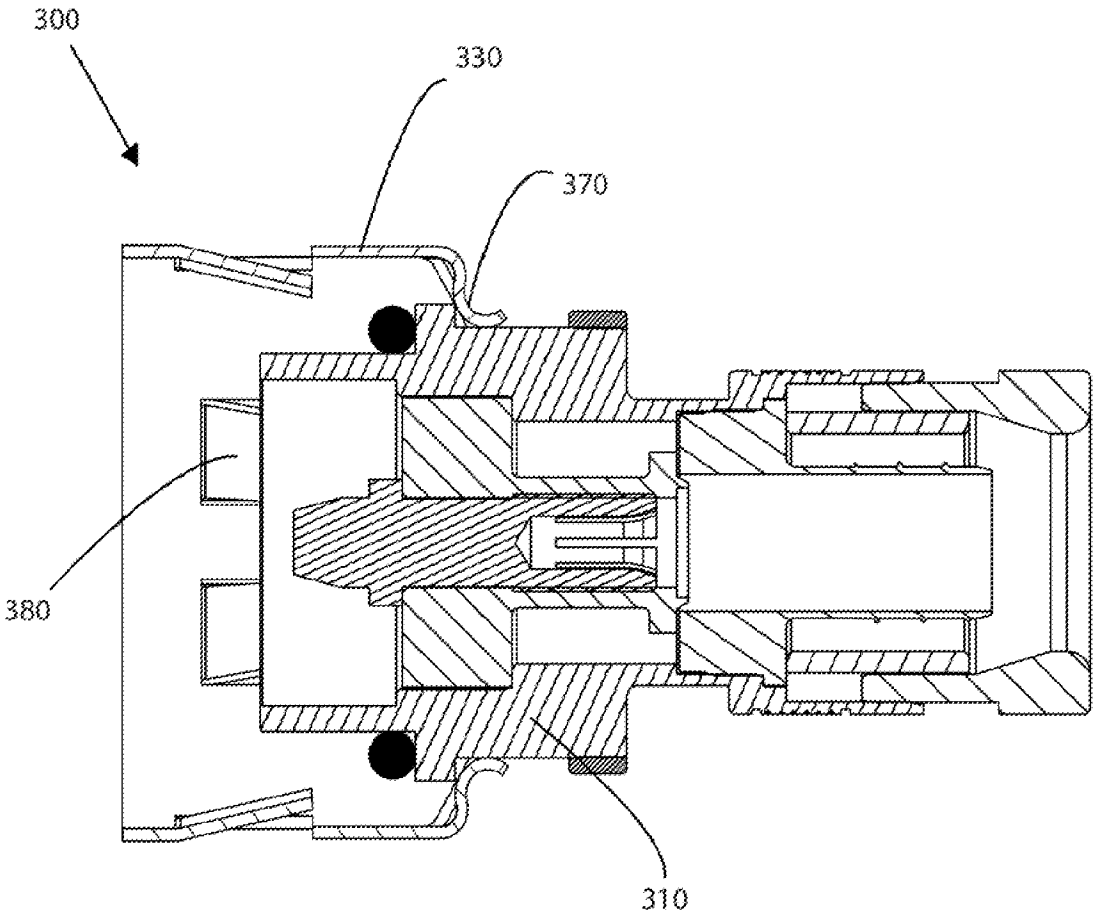
FIG. 9 depicts a cross-sectional view of a third embodiment of a coaxial cable connector.
Figure 10:
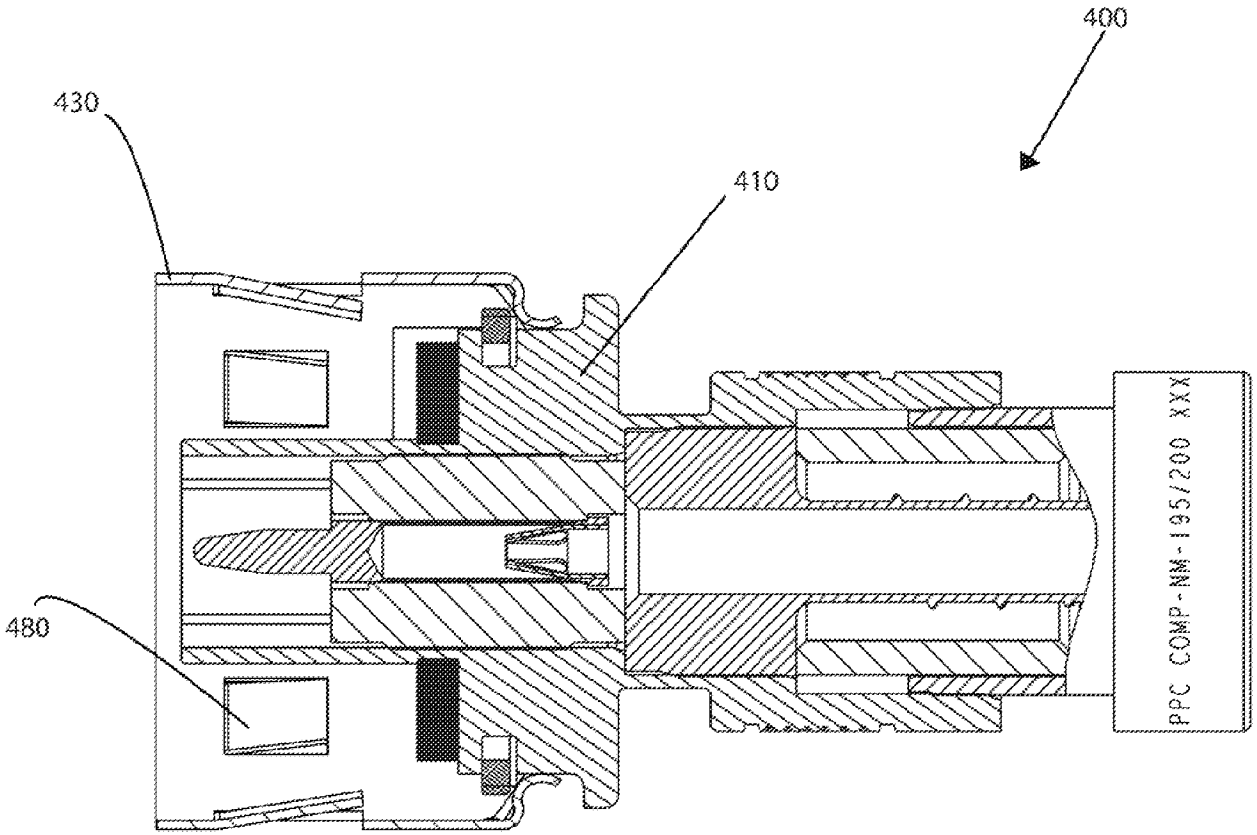
FIG. 10 depicts a cross-sectional view of a fourth embodiment of a coaxial cable connector.

Referring now to FIGS. 8-10, coaxial cable connectors other than a feed-through type connector, such as an F connector, can include a coupling member 230, 330, 430 that provides a retention force to prevent disengagement from a port 20 while also extending electrical continuity through the connector 200, 300 without contacting a post 40, or a component making direct contact with a port 20 that also is in physical contact with a prepared end of a coaxial cable 10. For example, embodiments of connectors 200, 300, 400 may include a coupling member 230, 330, 430 having a first set of contacts 270, 370, 470 to resiliently contact a conductive component 210, 310, 410 and a second set of contacts 280, 380, 480 configured to provide a retention force in an axial direction between the coupling member and the port 20 (as described above), wherein the conductive component 210, 310, 410, is a conductive component of the connector that contacts the a surface of the port 20 but does not physically contact a prepared end of a coaxial cable 10 (e.g. dielectric 16, outer conductive strand layer 14). Embodiments of coupling member 230, 330, 430 that may share the same or substantially the same structural and functional aspects of coupling member 30. However, coupling member 230, 330, 430 may be axially rotatable with respect to a conductive member 210, 310, 410 such that the coupling member 230, 330, 430 may freely rotate about at least the conductive member 210, 310, 410.

Figure 11A:
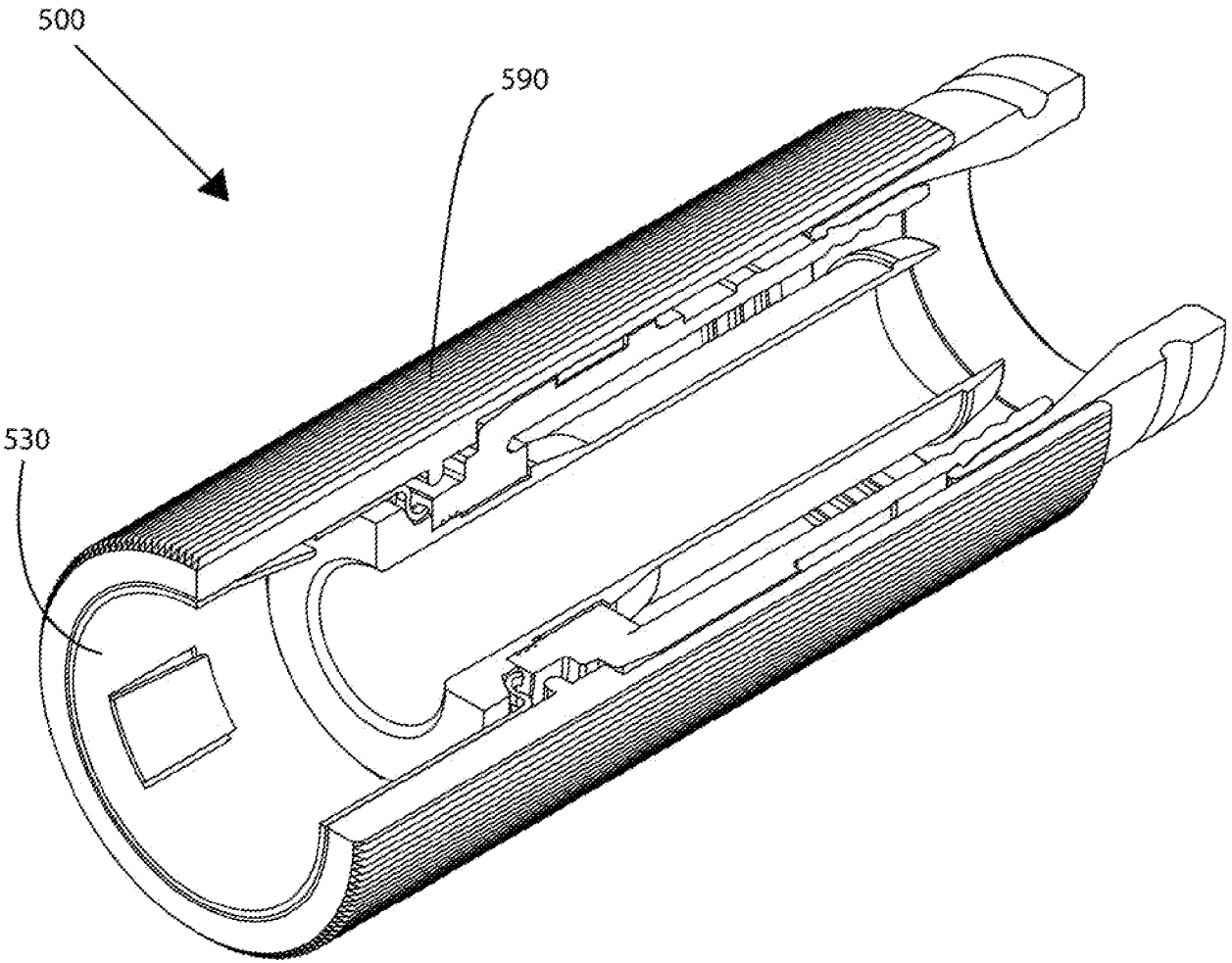
FIG. 11A depicts a perspective view of an embodiment of a fifth embodiment of a coaxial cable connector.
Figure 11B:
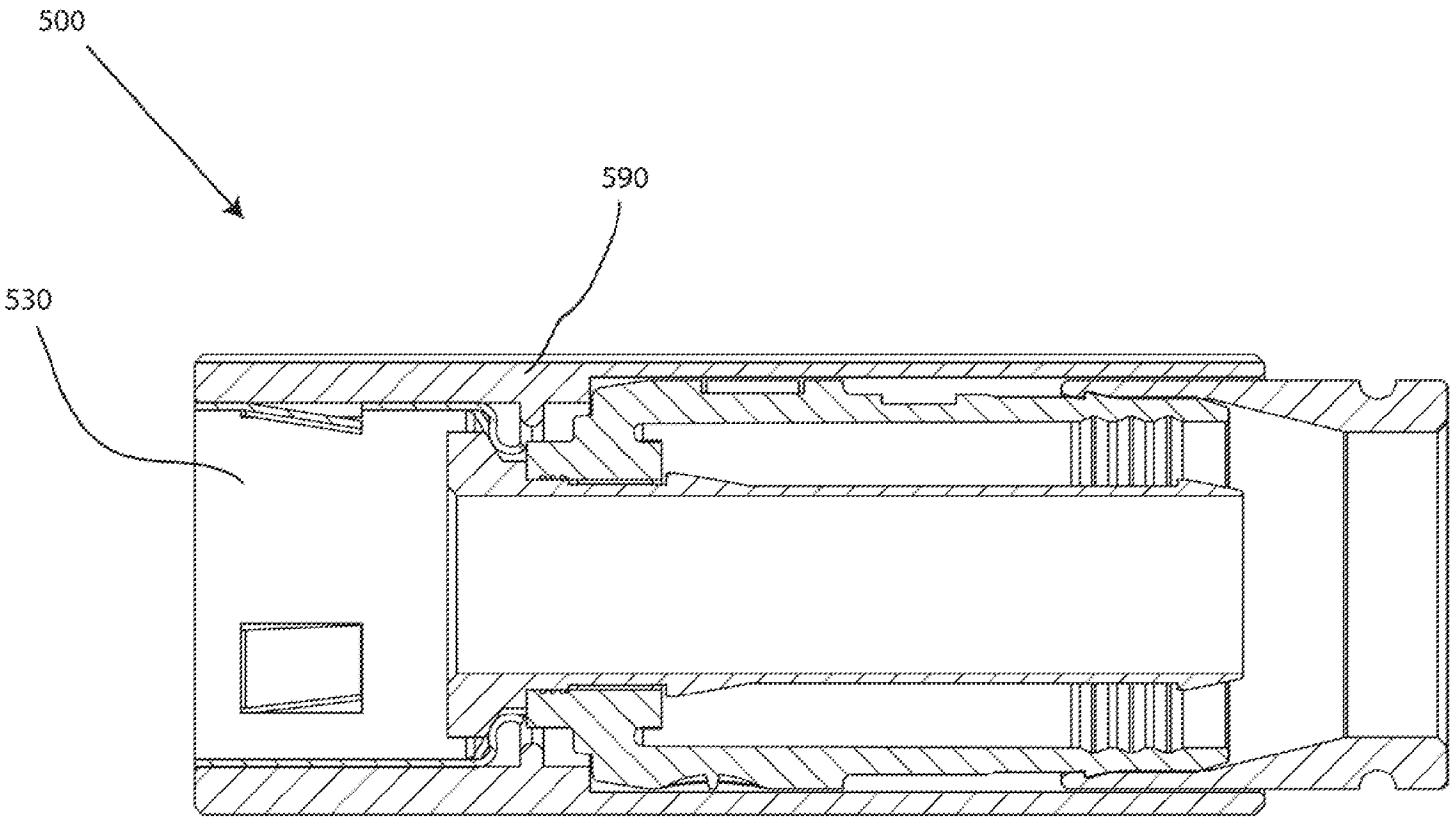
FIG. 11B depicts a cross-section view of an embodiment of the fifth embodiment of a coaxial cable connector.

With continued reference to the drawings, FIGS. 11A and 11B depict an embodiment of connector 500 including a coupling member 530 and an outer sleeve 590. Embodiments of coupling member 530 may share the same or substantially the same structure and function as coupling member 30. However, embodiments of coupling member 530 may be configured to mate with an outer sleeve 590. The coupling member 530 may have an annular groove or surface feature that cooperates with a groove or surface feature of the sleeve 590 to operably connect the outer sleeve 590 with the coupling member 530. Alternatively, the two components 530, 590 may be press-fit or rely on interference fit to operably connect. Operable connection between the coupling member 530 and outer sleeve 590 means that rotation or twisting of the outer sleeve 590 results in rotation of twisting of the coupling member 530, which can assist a user rotate the coupling member 530 in a reverse direction to disengage from the port 20. The outer sleeve 590 may have outer surface features to facilitate gripping of the outer sleeve 590.

Referring to FIGS. 1-12, a method of retaining a connector 100 onto a port 20 in an axial direction, may include the steps of providing a post 40 configured to receive a center conductor 18 surrounded by a dielectric 16 of a coaxial cable 10, a connector body 50 attached to the post 40, a coupling member 30 attached to the post 40, wherein the coupling member 30 has a first end 31 and second end 32, and forming one or more resilient contacts 80 on the coupling member 30, wherein the resilient contacts 80 are configured to pass over the external threads 24 in a first axial direction, and physically engage the external threads 24 in a second axial direction. The method may further include the step of facilitating continuity through the coaxial cable connector 100, wherein facilitating continuity includes forming one or more resilient protrusions 70 proximate the second end 32 of the coupling member 30, the resilient protrusions 70 configured to physically and electrically contact the post 40.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A jumper comprising:

a first connector attached to a coaxial cable, wherein the first connector includes a post configured to receive a center conductor surrounded by a dielectric of the coaxial cable, a connector body attached to the post, and a coupling member rotatably attached, and electrically grounded, to the post, the coupling member having one or more resilient contacts configured to engage with a working surface of an interface port after the coupling member is moved over the working surface in an axial direction; and a second connector;

wherein rotation of the coupling member effects rotation of the resilient contacts over the working surface to disengage the coupling member from the interface port.

2. The jumper of claim 1, wherein the second connector includes the same components as the first connector.

3. The jumper of claim 1, wherein the second connector is not identical to the first connector.

4. The jumper of claim 1, wherein the resilient contacts of the coupling member are configured to extend electrical continuity across a connection interface between the first connector and the interface port.

5. The jumper of claim 4, wherein the connection interface is an interface port on a signal receiving device.

6. The jumper of claim 1, wherein the coupling member includes a first and second set of resilient contacts, and wherein the first set of resilient contacts is structurally and electrically integral with the second set of resilient contacts.

7. The jumper of claim 1, wherein the working surface includes a profile surface of a spiral thread.

8. The jumper of claim 6, wherein the second set of resilient contacts is biased inwardly to engage the working surface of the interface port.

9. The jumper of claim 6, wherein the first set of resilient contacts is biased inwardly to maintain electrical continuity between the coupling member and the post.

10. The jumper of claim 6, wherein the first set of resilient contacts includes at least one resilient projection biased against the post to provide electrical continuity therebetween.

11. The jumper of claim 6, wherein the second set of resilient contacts is biased inwardly to engage the working surface of the interface port.

12. The jumper of claim 7, wherein the resilient contacts are normally biased such that an edge projects inwardly between a pair of axially-spaced threads to engage the respective profile surface of the spiral thread.

13. The jumper of claim 10 wherein the first set of resilient contacts includes a plurality of arcuate projections biased inwardly against a flange of the post.

14. A jumper comprising:

a first connector rotatably attached to a first end of a coaxial cable, the first connector including a post configured to receive a center conductor surrounded by a dielectric of the coaxial cable, a connector body attached to the post, and a coupling member attached, and electrically grounded, to the post, the coupling member having one or more resilient contacts configured with a working surface of an interface port after the coupling member is moved over the working surface in an axial direction, the coupling member including a coupling member body and a conductive grounding ring embedded within the coupling member body, the conductive grounding ring defining the one or more resilient contacts;

and a second connector rotatably attached to a second end of the coaxial cable wherein rotation of the first connector relative to the coaxial cable effects rotation of the resilient contacts over the working surface to disengage the coupling member from the interface port.

15. The jumper of claim 14, wherein the second connector includes the same components as the first connector.

16. A jumper comprising:

a first connector rotatably attached to a first end of a coaxial cable, the first connector including a post configured to receive a center conductor surrounded by a dielectric of the coaxial cable, a connector body attached to the post, and a coupling member attached, and electrically grounded, to the post, the coupling member having one or more resilient contacts configured with a working surface of an interface port after the coupling member is moved over the working surface in an axial direction, the coupling member including a coupling member body and a conductive grounding ring embedded within the coupling member body, the conductive grounding ring defining the one or more resilient contacts; and a second connector rotatably attached to a second end of the coaxial cable, the second connector including a post configured to receive a center conductor surrounded by a dielectric of the coaxial cable, a connector body attached to the post, and a coupling member attached, and electrically grounded, to the post, the coupling member having one or more resilient contacts configured with a working surface of an interface port after the coupling member is moved over the working surface in an axial direction, the coupling member including a coupling member body and a conductive grounding ring embedded within the coupling member body, the conductive grounding ring defining the one or more resilient contacts;

wherein rotation of one of the connectors relative to the coaxial cable effects rotation of the respective resilient contacts over the working surface to disengage the coupling member from the interface port, and wherein the resilient contacts are biased inwardly against the post.

17. The jumper of claim 16, wherein the connection interface is an interface port on a signal receiving device.

18. The jumper according to claim 16 wherein the coupling member includes a first and second set of resilient contacts, and wherein the first set of resilient contacts is structurally and electrically integral with the second set of resilient contacts.

19. The jumper according to claim 16 wherein the working surface includes a profile surface of a spiral thread.

* * * * *